US009119475B1

(12) United States Patent
Leal et al.

(10) Patent No.: US 9,119,475 B1
(45) Date of Patent: Sep. 1, 2015

(54) CONVERTIBLE FURNITURE FRAME ASSEMBLY

(71) Applicants: Jose M. Leal, Miami, FL (US); Jose M. Leal, Miami, FL (US)

(72) Inventors: Jose M. Leal, Miami, FL (US); Jose M. Leal, Miami, FL (US)

(73) Assignee: American Contract Seating, Inc., Miami, FL (US)

( * ) Notice: Subject to any disclaimer, the term of this patent is extended or adjusted under 35 U.S.C. 154(b) by 0 days.

(21) Appl. No.: 14/176,267

(22) Filed: Feb. 10, 2014

(51) Int. Cl.
*A47C 17/04* (2006.01)
*A47C 17/17* (2006.01)

(52) U.S. Cl.
CPC *A47C 17/17* (2013.01); *A47C 17/04* (2013.01)

(58) Field of Classification Search
CPC .. A47C 17/1753; A47C 17/175; A47C 17/17; A47C 17/2073; A47C 17/16; A47C 17/13; A47C 17/04
USPC ..... 5/16, 17, 18.1, 47, 48
See application file for complete search history.

(56) References Cited

U.S. PATENT DOCUMENTS 3,798,683 A * 3/1974 Alembik ..... 5/13
4,402,096 A * 9/1983 Atimichuk ..... 5/17
5,146,640 A * 9/1992 Barton et al. ..... 5/47
5,153,952 A * 10/1992 Barton et al. ..... 5/47
5,913,770 A * 6/1999 Tseng ..... 5/37.1
6,668,395 B1 * 12/2003 Chen ..... 5/47
6,789,848 B2 * 9/2004 Rauschenberger et al. ... 297/369
7,383,596 B2 * 6/2008 James et al. ..... 5/37.1
7,945,974 B2 5/2011 Cabrera et al.
8,225,439 B2 7/2012 Cabrera et al.
8,321,971 B2 12/2012 Cabrera et al.
8,464,370 B2 * 6/2013 Beck et al. ..... 5/47
8,468,621 B2 * 6/2013 Steers et al. ..... 5/13
8,555,431 B2 * 10/2013 Nielsen ..... 5/16
8,713,726 B1 * 5/2014 Erdman et al. ..... 5/57.1
2011/0185497 A1 * 8/2011 Grossman et al. ..... 5/282.1
2011/0277233 A1 * 11/2011 Beck et al. ..... 5/13

* cited by examiner

*Primary Examiner* — Robert G Santos
*Assistant Examiner* — Myles Throop
(74) *Attorney, Agent, or Firm* — Malloy & Malloy, P.L.

(57) ABSTRACT

A convertible furniture frame assembly includes a base frame assembly having one or more support members attached to the base frame assembly which are disposed to maintain the convertible furniture frame assembly in an operative position, such as, relative to an underlying floor surface. A cushion support assembly is interconnected to the base frame assembly and is disposable between an upright seated configuration and an extended horizontal configuration. A biasing assembly having a simple and compact construction is interconnected between the base frame assembly and the cushion support assembly to facilitate disposition of the cushion support assembly between the upright seated configuration and the extended horizontal configuration.

10 Claims, 12 Drawing Sheets

CONVERTIBLE FURNITURE FRAME ASSEMBLY

BACKGROUND OF THE INVENTION

1. Field of the Invention

The present invention is directed to a convertible furniture frame assembly to which a furniture piece may be mounted, wherein the convertible furniture frame assembly comprises a cushion support assembly which is disposable, i.e., "convertible", between an upright seated configuration, for use as a chair or sofa, and an extended horizontal configuration, for use as a bed. A compact biasing assembly is provided to facilitate disposition of the convertible furniture frame between the upright seated configuration and the extended horizontal configuration.

2. Description of the Related Art

Over the years, various types of convertible furniture pieces have been produced, such that a single piece of furniture can serve multiple functions thereby, presumably, reducing the cost of purchasing a multiplicity of separate furniture pieces, as well as minimizing the space requirements for multiple individual furniture pieces.

A common example of a convertible furniture piece is a reclining chair, which is normally disposed in a seated configuration but which, however, is readily transformed into various states of repose or recline by a user sitting thereon.

Another common type of convertible furniture is the well-known "sofa bed". Sofa beds, from the outside, appear almost indiscernible from a standard sofa and are available in any of a variety of sizes, shapes, colors, fabrics, and designs. However, upon removal of one or more seat cushions from the sofa bed, the underlying mattress and support structure are revealed and are accessible to user in order to transform the "sofa bed" from the sofa configuration to the bed configuration. Typically, this involves a user or users pulling up on a heavily spring-laden mattress support mechanism which is folded unto itself and rearward and under the back of the sofa when it is in a stored configuration. As is well known, the underlying mattress support mechanisms are heavy, complex, and expensive to manufacture, and the result is a furniture piece which is clumsy and at times dangerous for a user or users to move and/or operate.

Another form of convertible furniture that is well known and in wide use is the futon. Futons typically comprise a wood or metal frame that serves both as a seat and back when disposed in a seating orientation or as an underlying mattress frame when the futon is disposed in the a sleeping configuration. While futons are much simpler in design and structure relative to the aforementioned "sofa bed" type structures, however, futons are not in the same class with regard to the aesthetic appeal of a standard sofa bed. In addition, the support provided by a typical futon mattress and the underlying mattress frame is also in general, not up to par with a typical "sofa bed" type structure.

As such, it would be beneficial to provide a convertible furniture frame to which a furniture piece may be mounted so as to maintain a level of aesthetic appeal often desired by consumers, as well as, simplifying the structures required in order to "convert" the furniture frame between an upright seated configuration and an extended horizontal orientation for use as a bed. It will further be helpful for such a convertible frame assembly to have a biasing assembly comprising compact and simplified construction to facilitate disposing the convertible furniture frame assembly between seated and horizontal configurations. Another advantage may be realized by providing a convertible furniture frame assembly having a simple yet effective locking assembly which securely retains the furniture frame assembly in an upright seated configuration until such time a user releases the locking assembly thereby allowing the convertible furniture frame to be disposed in a horizontal configuration.

SUMMARY OF THE INVENTION

The present invention is directed to a convertible furniture frame assembly onto which a furniture piece is mounted. In one embodiment, a convertible furniture frame assembly comprises a base frame assembly having a main frame, and in one further embodiment, the main frame includes oppositely disposed rails forming a generally square or rectangular configuration. A plurality of outer rails each disposed in a spaced apart relation to the main frame are provided in at least one embodiment of the present invention.

A plurality of support members are attached to a portion of the base frame assembly, in one embodiment, and are disposed to maintain the convertible furniture frame assembly in an operative position, such as on an underlying support surface. In at least one embodiment, the plurality of support members are attached to the underside of one or more outer rails.

At least one embodiment of a convertible furniture frame assembly in accordance with the present invention includes a cushion support assembly comprising a plurality of cushion supports movably interconnected to one another, wherein the cushion support assembly is disposable between an upright seated configuration and an extended horizontal configuration. In at least one further embodiment, a cushion support assembly comprises an inner cushion support, a central cushion support, and an outer cushion support which are each movably interconnected to one another, such as via cooperatively disposed hinge(s), such that the overall cushion support assembly is disposable between an upright seated configuration and an extended horizontal configuration.

A biasing assembly is interconnected between the base frame assembly and the cushion support assembly in accordance with at least one embodiment of a convertible furniture frame assembly in accordance with the present invention to further facilitate disposition of the cushion support assembly between an upright seated configuration and an extended horizontal configuration.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION

Figure 1:
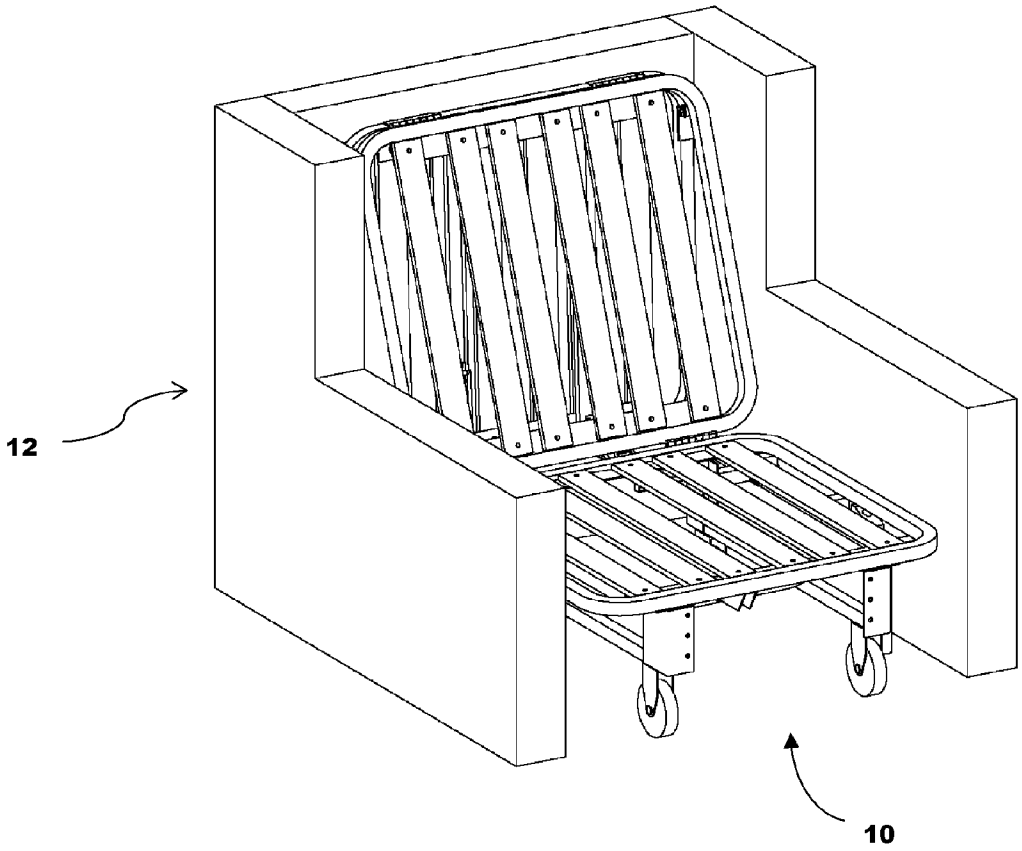
FIG. 1 is a perspective view illustrative of one embodiment of a convertible furniture frame assembly in accordance with the present invention disposed in an upright seated configuration and having a furniture piece mounted thereto.

As previously stated, the present specification is directed to a convertible furniture frame assembly which is generally shown as 10 throughout the figures. More in particular, and as best shown in FIG. 1, a convertible furniture frame assembly 10 in accordance with the present invention is structured for use in combination with a furniture piece 12, such as, for example, the chair shown in FIG. 1. Of course, it will be appreciated by those skilled in the art that the present convertible furniture frame assembly 10 may be used in combination with other furniture pieces 12 including, but not limited to, a full size sofa, a queen size sofa, or a king size sofa, just to name a few. A furniture piece 12 is securely mounted to a convertible furniture frame assembly 10 in accordance with the present invention by way of one or more furniture mounting bracket 29, as discussed in further detail below.

As the name implies, a convertible furniture frame assembly 10 in accordance with the present invention is disposable, or "convertible", between a plurality of configurations depending on the desired mode of use. For example, as shown in FIGS. 1 and 2, a convertible furniture frame assembly 10 in accordance with the present invention is disposable into an upright seated configuration such that a user or users may sit upon one portion of the convertible furniture frame assembly 10, namely, an outer cushion support 36, as discussed further below, with his or her back supported by another portion, namely, a central cushion support 34, such as is shown in FIG. 2, and again, as described in further detail below. Although not shown, one or more cushions are attached to cushion supports 34 and 36 to comfortably support a user or users sitting thereupon.

Figure 3:
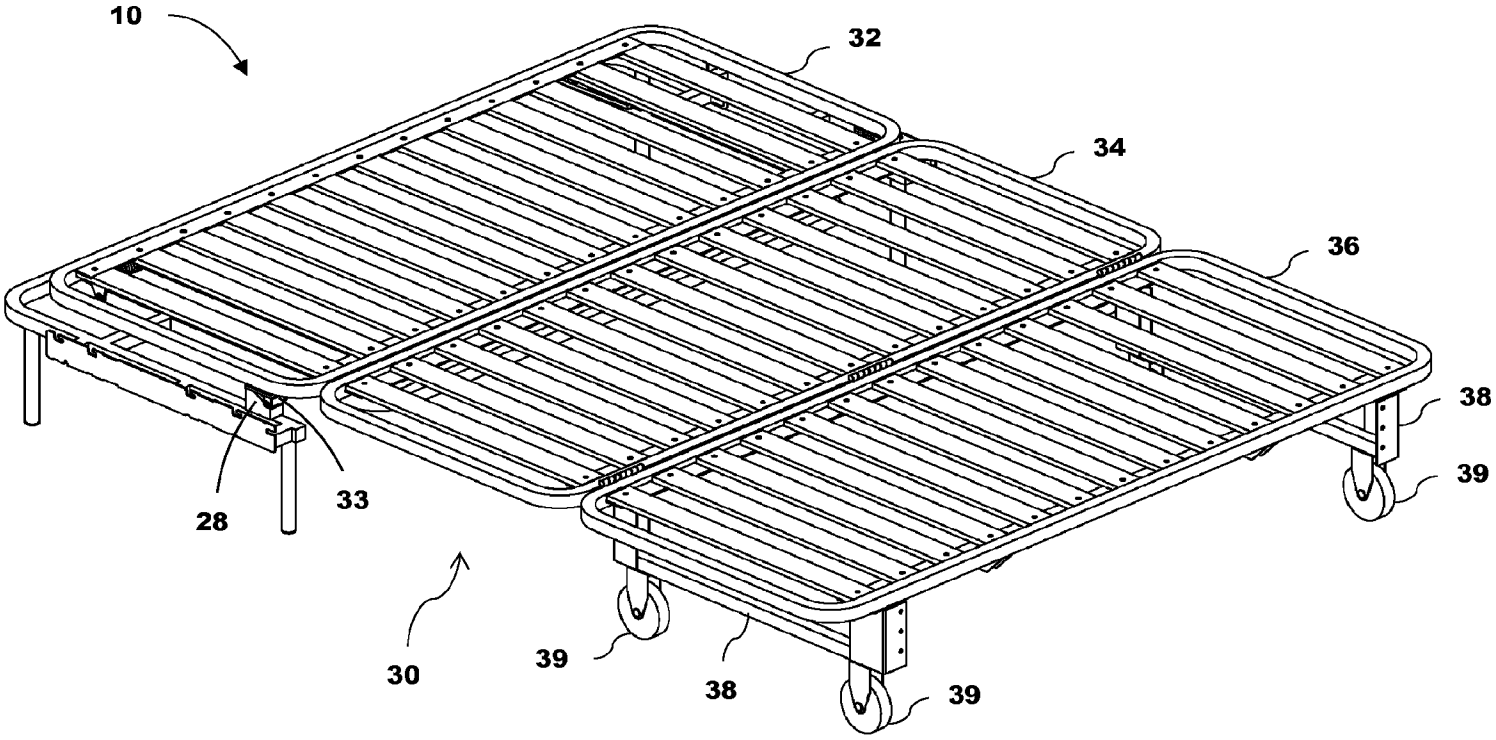
FIG. 3 is a perspective view of the illustrative embodiment of the convertible furniture frame assembly of FIG. 2 in an extended horizontal configuration.

FIG. 3 is illustrative of one embodiment of a convertible furniture frame assembly 10 in accordance with the present invention disposed in an extended horizontal configuration wherein each of a plurality of cushion supports 32, 34, 36 of a cushion support assembly 30 are disposed in a generally aligned horizontal orientation. Once again, although not shown, each of cushion supports 32, 34, 36, are structured to receive one or more cushions attached thereto in an overlying configuration. As such, when a convertible furniture frame assembly 10 in accordance with the present invention is disposed in an extended horizontal configuration, as shown in FIG. 3, the cushion or cushions (not shown) provide a comfortable support surface for a user or users to lie upon to rest and/or sleep. Once again, as will be appreciated by those skilled in the art, individual cushions may be provided to attach individually to each of cushion supports 32, 34, 36, or a single cushion may be provided which extends over and is attached to each of cushion supports 32, 34, 36, in order to provide a comfortable support surface for a user or users to sit or lie upon.

Figure 4:
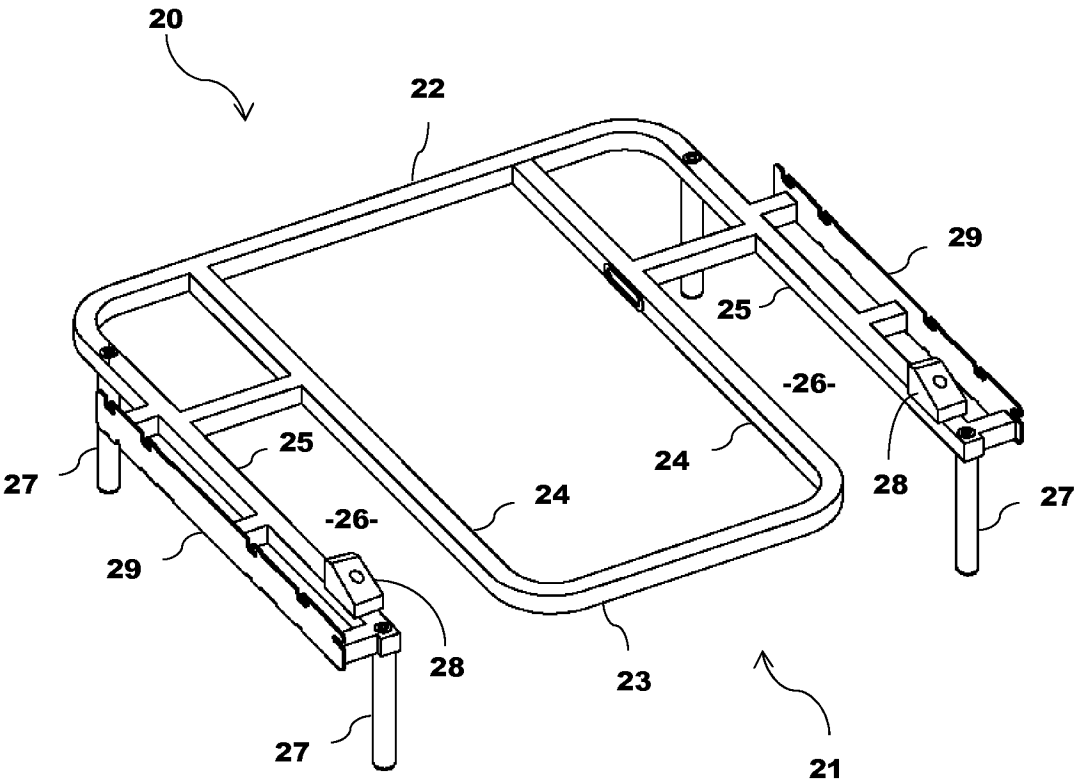
FIG. 4 is a perspective view illustrative of one embodiment of a base frame assembly of a convertible furniture frame assembly for a chair in accordance with the present invention.
Figure 5:
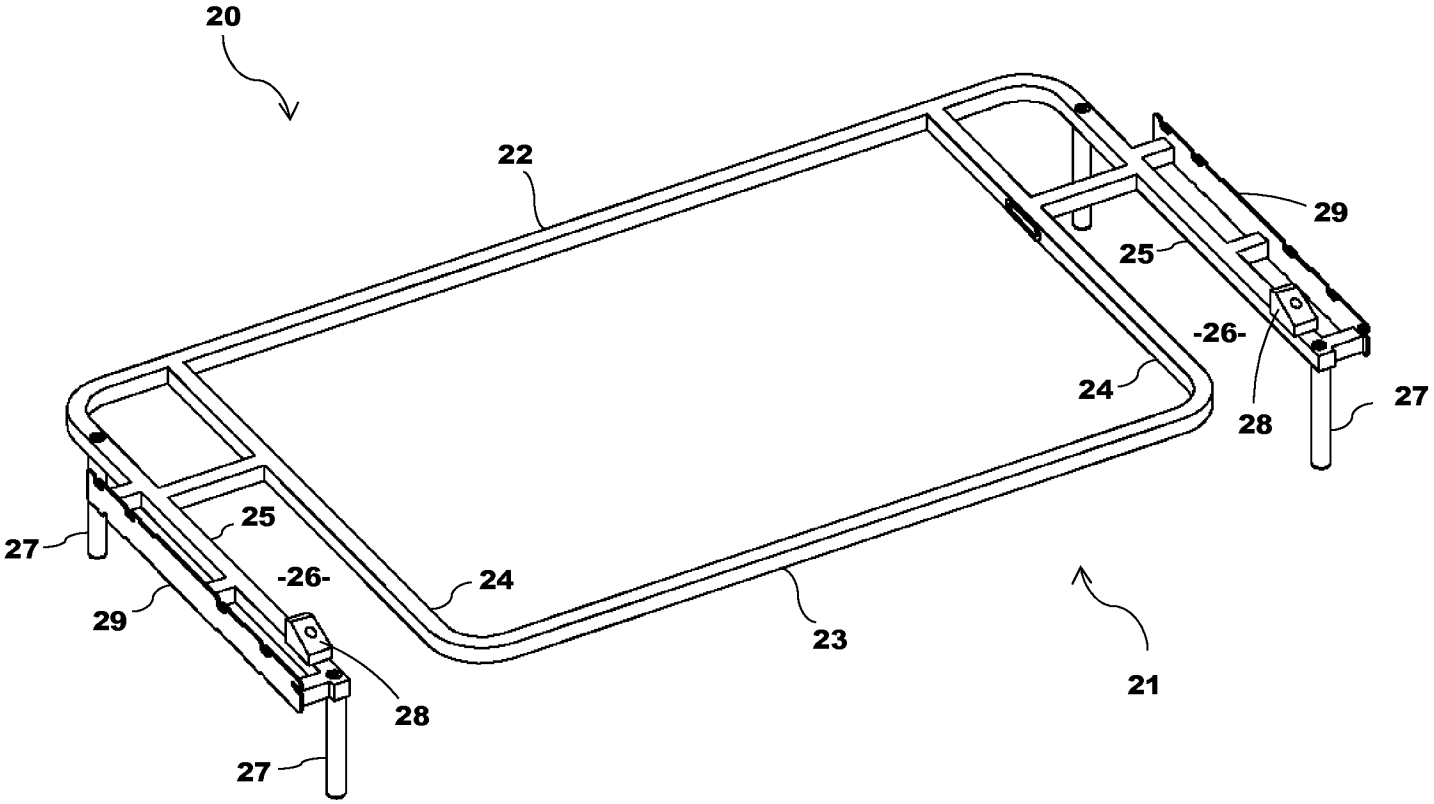
FIG. 5 is a perspective view illustrative of one embodiment of a base frame assembly of a convertible furniture frame assembly for a queen size sofa in accordance with the present invention.
Figure 6:
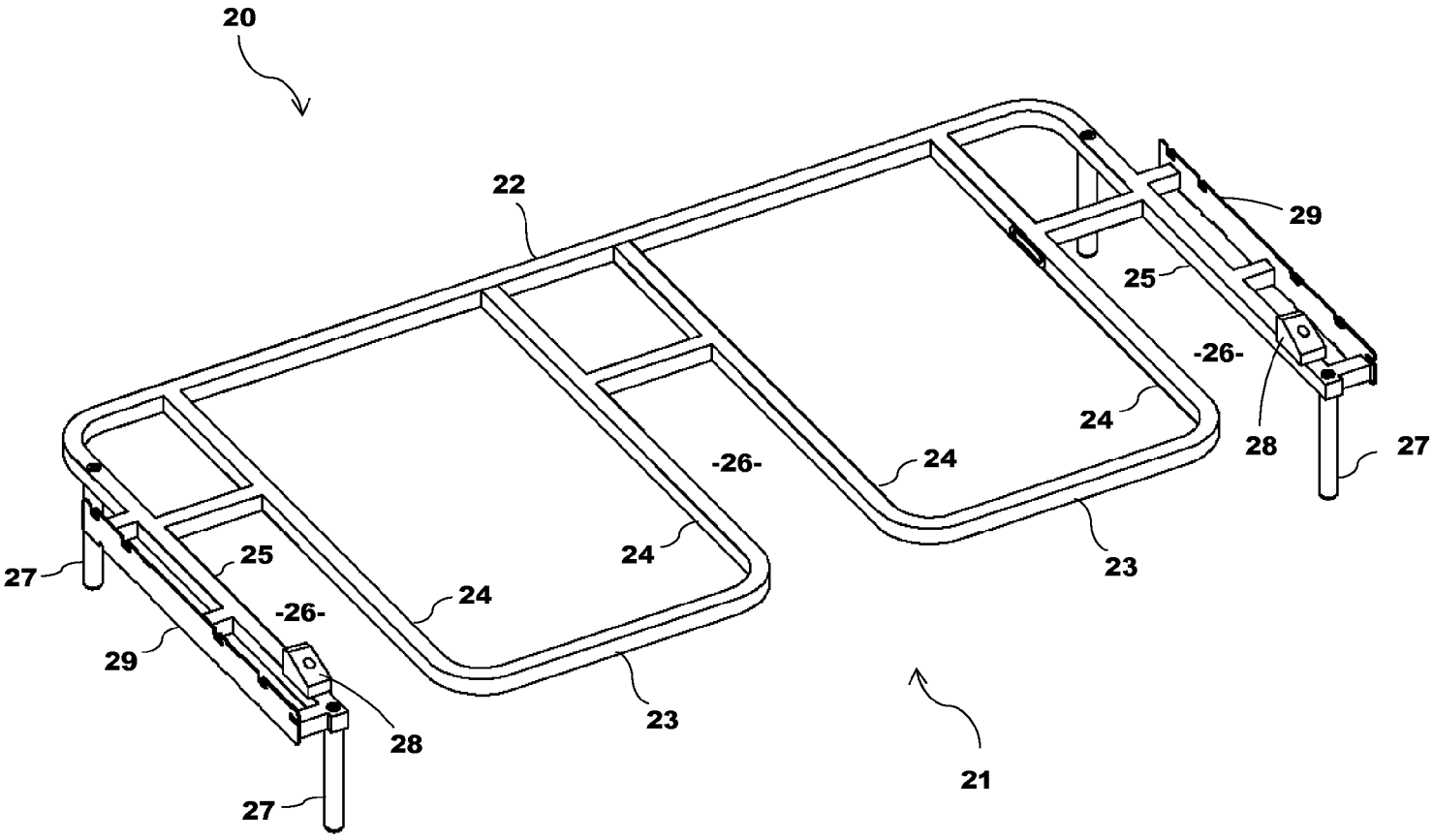
FIG. 6 is a perspective view illustrative of one embodiment of a base frame assembly of a convertible furniture frame assembly for a king size sofa in accordance with the present invention.

In at least one embodiment, a convertible furniture frame assembly 10 in accordance with the present invention comprises a base frame assembly 20. FIGS. 4 through 6 are illustrative of various embodiments of a base frame assembly 20 which may be utilized with a convertible furniture frame assembly 10 in accordance with the present invention. More in particular, FIG. 4 is illustrative of a base frame assembly 20 for a convertible furniture frame assembly 10 to be used in conjunction with a chair. FIG. 5 is illustrative of base frame assembly 20 for a convertible furniture frame assembly 10 to be utilized in conjunction with a full or queen size sofa, the difference being larger overall dimensions are required for a queen size sofa. Furthermore, FIG. 6 is illustrative of a base frame assembly 20 of a convertible furniture frame assembly 10 to be utilized with a king size sofa.

With reference to the illustrative embodiments of FIGS. 4 and 5, a base frame assembly 20 includes a main frame 21 which includes a rear rail 22 and a lock rail 23 which are oppositely disposed and spaced apart from one another. Further, as shown in the illustrative embodiments of FIGS. 4 and 5, the main frame 21 comprises a plurality of oppositely disposed and spaced apart mount rails 24 which interconnect rear rail 22 and lock rail 23 to form an essentially square (FIG. 4) or rectangular (FIG. 5) main frame 21. As may be seen in the illustrative embodiment of FIG. 6, the main frame 21 of a base frame assembly 20 for a king size sofa comprises a plurality of lock rails 23 each of which are interconnected to rear rail 22 by a corresponding pair of oppositely disposed and spaced apart mount rails 24.

Figure 2:
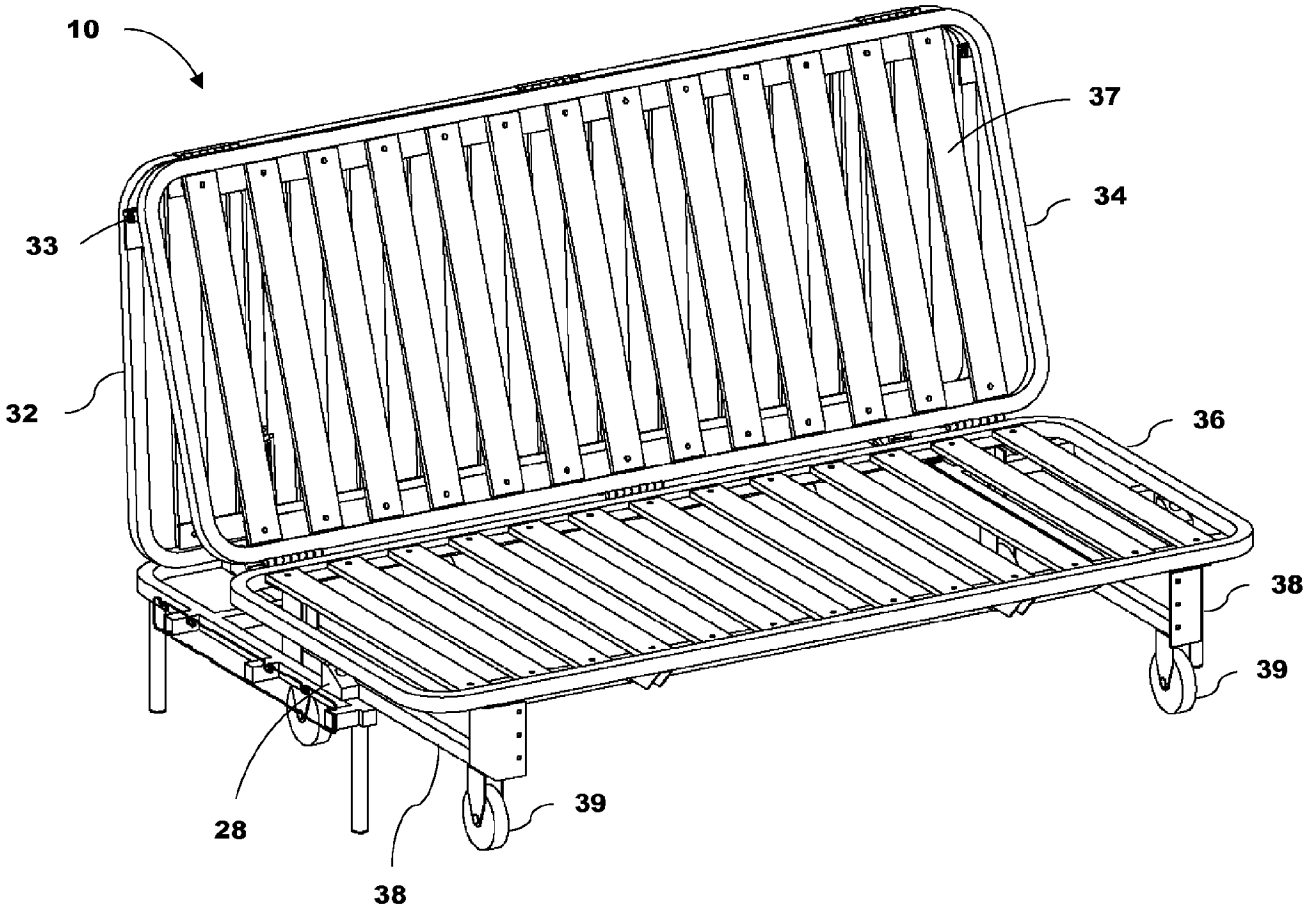
FIG. 2 is a perspective view illustrative of another embodiment of a convertible furniture frame assembly in accordance with the present invention in an upright seated configuration.

Looking again to FIGS. 4 and 5, the base frame assembly 20 further comprises a plurality of outer rails 25 which are spaced apart and oppositely disposed from corresponding mount rails 24 of the main frame 21. As may be seen from FIGS. 4 and 5, channels 26 are formed between corresponding ones of the outer rails 25 and mount rails 24, wherein the channels 26 facilitate positioning of a corresponding wheel assembly 38 therein while the convertible furniture frame assembly 10 is disposed in an upright seated configuration, as shown in FIG. 2 and as is discussed in further detail below. Furthermore, with reference to FIG. 6, an additional channel 26 is formed between innermost mount rails 24 in order to facilitate positioning of a further wheel assembly 38 which is provided in at least one embodiment of a convertible furniture frame assembly 10 for a king size sofa in accordance with the present invention.

One or more support members 27 are attached to the underside of the base frame assembly 20 in order to support a convertible furniture frame assembly 10 in accordance with the present invention in an operative position relative to a supporting surface, such as, a floor. As shown in the illustrative embodiments of FIGS. 4 through 6, the plurality of support members 27 are attached to the underside of outer rails 25, and more in particular, a support member 27 is attached at both the front and rear of each outer rail 25.

In at least one embodiment, a stop member 28 is mounted onto the top surface of each outer rail 25 of a base frame assembly 20 in accordance with the present invention. As shown best in the illustrative embodiments of FIGS. 4 through 6, each stop member 28 is independent of and is disposed separate and spaced apart from the support members 27 attached to the corresponding outer rail 25. In one embodiment, each stop member 28 is attached to a corresponding outer rail 25 via a bolt threaded into or through a portion of the outer rail 25. Further, each stop member 28 is disposed to be contacted by a portion of an inner cushion support 32 when a convertible furniture frame assembly 10 in accordance with the present invention is disposed in an extended horizontal configuration, as discussed in further detail below. In accordance with at least one embodiment of the present invention, a stop member 28 comprises a hard rubber or plastic material of construction, however, it is envisioned to be within the scope and intent of the present invention for a stop member 28 to be constructed from any of a variety of other solid, relatively non-pliant materials as well including, but not limited to, metal, metal alloy, engineered plastic, wood, ceramic, etc.

FIGS. 4 through 6 further illustrate furniture mounting brackets 29 attached to each outer rail 25 and, as disclosed above, the furniture mounting brackets 29 are utilized to secure a furniture piece 12 to a convertible furniture frame assembly 10 in accordance with the present invention. Although not shown, it is understood that one or more additional furniture mounting brackets 29 can be attached to rear rail 22 of the main frame 21 in order to further facilitate mounting a furniture piece 12 to the convertible furniture frame assembly 10 in accordance with the present invention.

The rails 22, 23, 24, and 25 of the base frame assembly 20 in at least one embodiment are constructed of a lightweight metal tube, such as may be manufactured by extrusion or similar process. In at least one embodiment, the rails 22, 23, 24, and 25 are constructed of black coil steel having a tube wall thickness of about 1.4 millimeters wherein the steel comprises a black powder coating, e.g., KD construction. In at least one other embodiment, the rails 22, 23, 24, and 25 are constructed of tubular 1×1 CRS caliber 16 steel having a laminate caliber of 16 & 14. It is, of course, understood to be within the scope and intent of the present invention for other materials including, but not limited to, metal, metal alloy, extruded tubing, wood, or engineered plastic to be utilized to form the rails 22, 23, 24, and 25 of the base frame assembly 20.

As previously indicated, a convertible furniture frame assembly 10 in accordance with at least one embodiment of the present invention comprises a cushion support assembly 30. A cushion support assembly 30 in accordance with the present invention includes a plurality of cushion supports 32, 34, and 36, which are movably interconnected to one another and are cooperatively disposable between an upright seated orientation and an extended horizontal orientation, as shown in the figures. In at least one embodiment of a convertible furniture frame assembly 10 in accordance with the present invention, a cushion support assembly 30 comprises an inner cushion support 32, a central cushion support 34, and an outer cushion support 36 which, as noted above, are movably interconnected to one another and are cooperatively disposable between an upright seated orientation and an extended horizontal orientation. As stated above with regard to rails 22, 23, 24, and 25, in at least one embodiment, the cushion supports 32, 34, and 36 are constructed of black coil steel having a tube wall thickness of about 1.4 millimeters wherein the steel comprises a black powder coating, and in one other embodiment, the cushion supports 32, 34, and 36 are constructed of tubular 1×1 CRS caliber 16 steel having a laminate caliber of 16 & 14. It is, once again, understood to be within the scope and intent of the present invention for other materials including, but not limited to, other metals, metal alloys, extruded tubing, wood, or engineered plastics to be utilized to construct the cushion supports 32, 34, and 36 in accordance with the present invention.

As shown in the illustrative embodiments of the figures, cushion supports 32, 34, and 36 comprise one or more cross member 37 which provide support for a cushion attached thereto, as well as to support a user or users seated or lying on the cushions. In at least one embodiment, the cross members 37 are constructed of bamboo, however, other materials of construction of a cross member 37 include wood, metal, plastic, engineered plastic, etc., may be utilized equally well in conjunction with the present invention.

In at least one embodiment, an inner cushion support 32 includes at least one stop member interface 33 mounted on its underside, as shown in FIG. 2, which is disposed into contact with a corresponding stop member 28 mounted onto a portion of a base frame assembly 20 when the cushion support assembly 30 is disposed in an extended horizontal orientation, as is shown best in FIG. 3. In at least one embodiment, a stop member interface 33 comprises a roller which is rotationally mounted in a bracket, such that the roller rolls over and off of the stop member 28 when the cushion support assembly 30 is disposed from an extended horizontal orientation into an upright seated orientation, once again, facilitating disposition of the cushion support assembly 30 between configurations.

With reference to FIGS. 2 and 3, in at least one embodiment, cushion support assembly 30 comprises a wheel assembly 38 which provides further support for the convertible furniture frame assembly 10 and facilitates disposition of the convertible furniture frame assembly 10 between an upright seated configuration and an extended horizontal configuration. In at least one embodiment, a wheel assembly 38 comprises a plurality of wheels 39 affixed to the underside of one of a plurality of cushion supports, and in one further embodiment, a plurality of wheel assemblies 38 are affixed to the underside of an outer cushion support 36, as shown best in FIGS. 2 and 3. With further reference to FIG. 2, when the cushion support assembly 30 of the convertible furniture frame assembly 10 is disposed in an upright seated configuration, the wheel assemblies 38 are disposed within corresponding channels 26 of the underlying base frame assembly 20.

Figure 7:
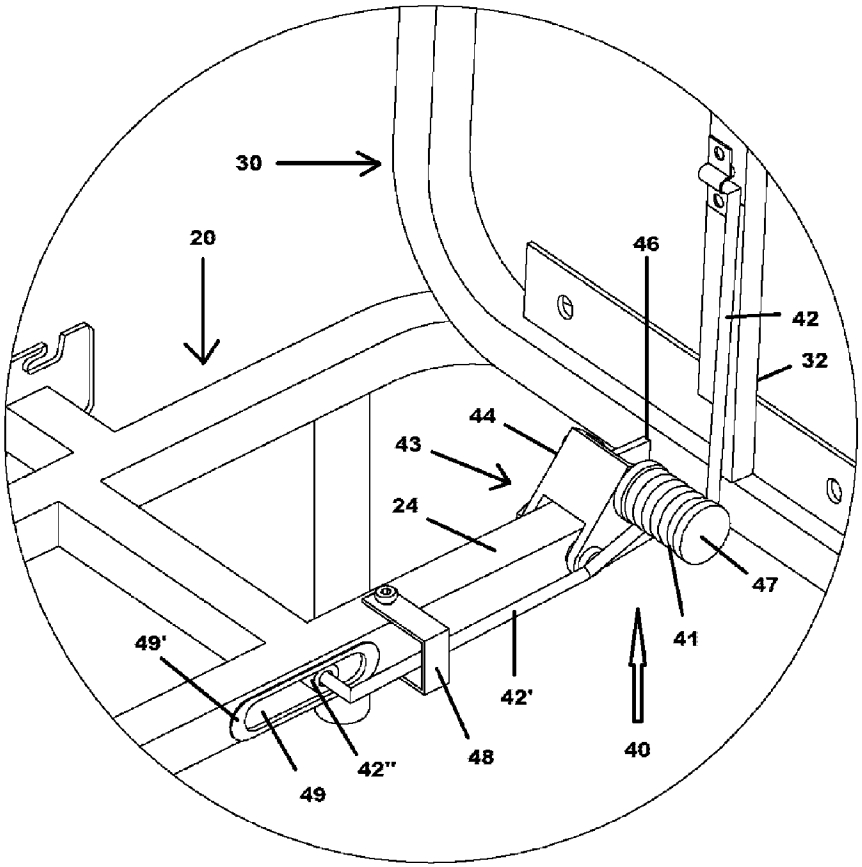
FIG. 7 is a perspective view illustrative of one embodiment of biasing assembly for a convertible furniture frame assembly in accordance with the present invention disposed in an extended orientation while the convertible furniture frame assembly is disposed in a seated configuration.

With reference to FIG. 7, and as previously noted above, at least one embodiment of a convertible furniture frame assembly 10 in accordance with the present invention comprises a biasing assembly 40. As shown in FIG. 7, the biasing assembly 40 is interconnected between the base frame assembly 20 and the cushion support assembly 30. More in particular, the biasing assembly 40 facilitates disposition of the convertible furniture frame assembly 10 between an upright seated configuration, once again, as shown in FIGS. 1 and 2, and an extended horizontal configuration such as shown best in FIG. 3. As my be seen from the illustrative embodiment of FIG. 7, the biasing assembly 40 comprises a compact and simplified construction in accordance with at least one embodiment of the present invention.

In at least one embodiment, a biasing assembly 40 in accordance with the present invention comprises a biasing element 41 having a plurality of terminal members 42, 42'. As shown in the illustrative embodiment of FIG. 7, terminal members 42, 42' comprise elongated configurations extending outwardly from either end of a spring-like biasing element 41. As further illustrated in FIG. 7, at least one of the terminal members 42 is fixedly secured to the cushion support assembly 30, and more in particular, to the inner cushion support 32 via a mounting bracket, also as shown in FIG. 7. Of course it is understood that the terminal member 42 may be fixedly secured to the inner cushion support 32 by other means, such as, by way of example only, via welding.

Another terminal member 42' is disposed in a sliding engagement with a portion of a base frame assembly 20, and in one further embodiment, the terminal member 42' is disposed in a sliding engagement with a corresponding mount rail 24, as illustrated in the embodiment of FIG. 7. More in particular, the corresponding mount rail 24 comprises a positioning channel 49 having an elongated configuration into which at least a portion of the terminal member 42' is slidingly disposed. In at least one embodiment, a sleeve 49' is mounted around the periphery of the positioning channel 40, as shown in FIG. 7, and in one further embodiment, the sleeve 49' comprises a material having a low coefficient of friction so as not to inhibit movement of the portion of terminal member 42' disposed therein. Similarly, in yet one further embodiment, a cap 42" is mounted over at least a portion of the terminal member 42' disposed in the positioning channel 49, as shown in FIGS. 7 and 8, wherein the cap 42" is also constructed of a material having a low coefficient of friction, once again, so as to facilitate the sliding movement of the portion of the terminal member 42' in the positioning channel 49.

As further shown in the illustrative embodiment of FIG. 7, a retention bracket 48 is positioned in an overlying disposition across a length of terminal member 42' so as to prevent inadvertent displacement of the portion of the terminal member 42' disposed in the positioning channel 49.

The biasing assembly 40 in at least one embodiment of the present invention further comprises a pivot assembly 43 disposed in a pivoting engagement between the base frame assembly 20 and the cushion support assembly 30, wherein the pivot assembly 43 is disposed to further facilitate disposition of the cushion support assembly 30 between an upright seated configuration and an extended horizontal configuration. As shown in FIG. 7, the pivot assembly 43 comprises a pivot element 44 pivotally interconnected to a portion of the base frame assembly 20 via pivot pin 45 (FIG. 9), and more in particular, the pivot element 44 is pivotally interconnected to a portion of a mount rail 24 of the base frame assembly 20. Of course, it is within the scope and intent of the present invention for a pivot element 44 and a pivot assembly 43 to be pivotally interconnected to a portion of the cushion support assembly 30.

Figure 8:
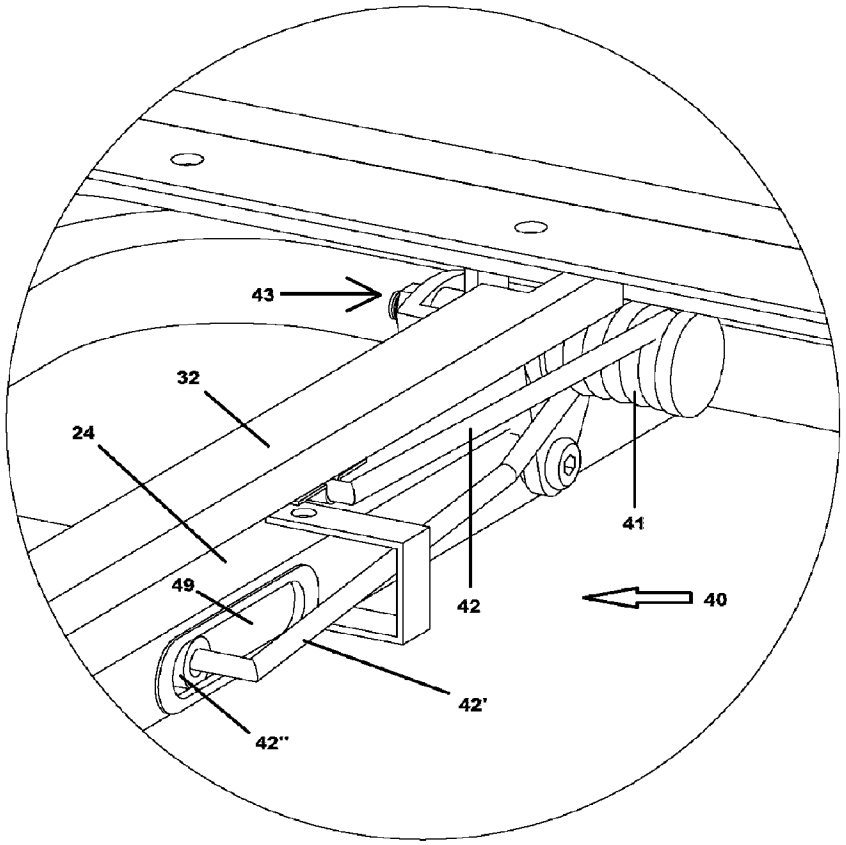
FIG. 8 is a perspective view of the embodiment of the biasing assembly of FIG. 7 in a compressed orientation while the convertible furniture frame assembly is disposed in an extended horizontal configuration.
Figure 9:
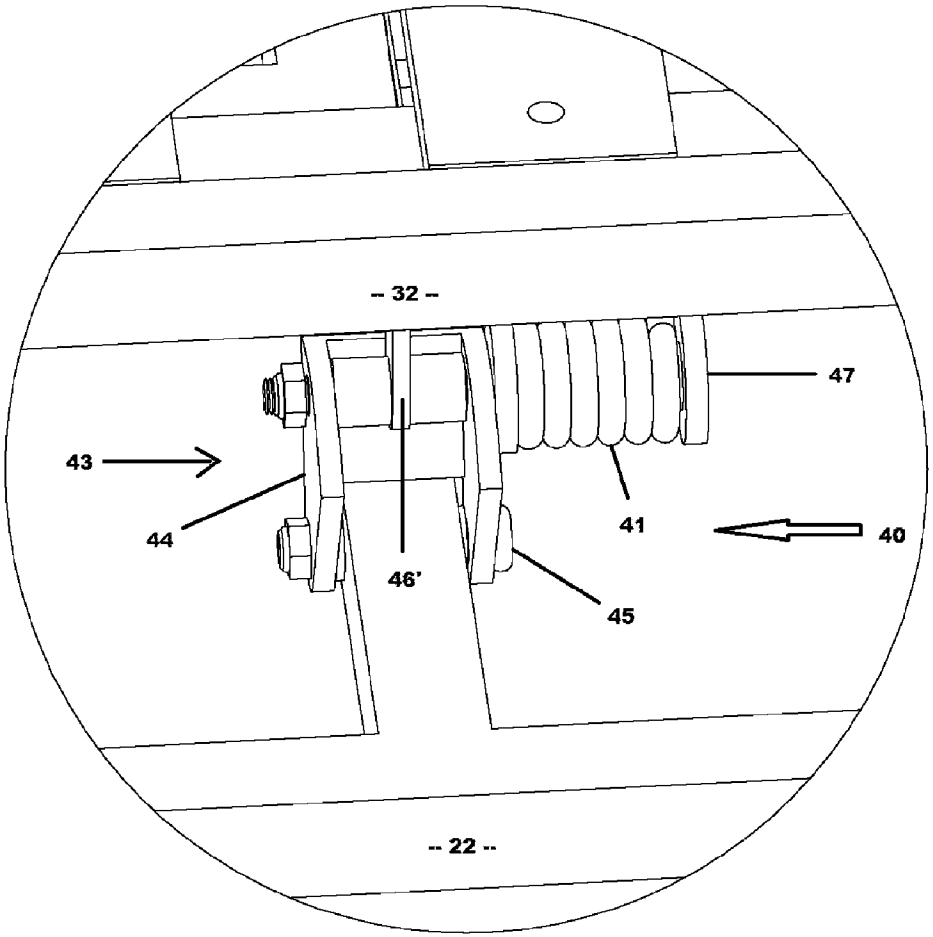
FIG. 9 is a rear view of a portion of the embodiment of the biasing assembly of FIG. 7.

Looking once again to the illustrative embodiment of FIGS. 7-9, the biasing assembly 40 further comprises a fixed element 46 which is fixedly mounted to a portion of the cushion support assembly 30, and more in particular, in at least one embodiment, the fixed element 46 is fixedly mounted to a portion of an inner cushion support 32. Fixed element 46, in at least one embodiment, comprises a mounting bracket 46' which extends outwardly therefrom and is operatively interconnected to a pivot element 44 via a biasing element interconnect 47. As may be seen best in the embodiment of FIG. 9, the biasing element interconnect 47 comprises a nut and bolt which extends through a portion of each of the biasing element 41, pivot element 44, and fixed element 46, thereby operatively interconnecting the biasing element 41 to the pivot assembly 43. As further shown in FIG. 9, in at least one embodiment bushings are disposed between the pivot element 44 and the mounting bracket 46' of the fixed element 46, with the bolt extending through the bushings as well. Of course, it will be appreciate that the biasing element interconnect 47 may comprise other means of interconnecting the biasing element 41 to the pivot element 44 and the fixed element 46, such as, a lock pin, an elongated rivet, ties, welds, etc.

Of course, it will be appreciated by those of skill in the art that a biasing assembly 40 in accordance with the present invention may comprise a plurality of biasing elements 41 and a corresponding plurality of pivoting assemblies 43 operatively disposed therewith, such as is illustrated throughout the figures. It is further understood that while disclosed herein in connection with the illustrative embodiments presented in the figures, a biasing assembly 40 in accordance with the present invention could comprise a pivot assembly 43 affixed to a portion of a cushion mount support assembly 30 and a fixed element 46 fixedly mounted to a portion of a based frame assembly 20.

FIG. 7 is a perspective view illustrative of one embodiment of a biasing assembly 40 in accordance with the present invention wherein a biasing element 41 is disposed in an expanded orientation while a cushion support assembly 30 of a convertible furniture frame assembly 10 is disposed in an upright seated configuration. FIG. 8 is a perspective view of an embodiment of biasing assembly 40 disposed in a compressed orientation while a cushion support assembly 30 of a convertible furniture frame assembly 10 is disposed in an extended horizontal configuration.

As will be appreciated from the foregoing, a biasing assembly 40 in accordance with the present invention facilitates the disposition of a cushion support assembly 30 and more in particular, a plurality of interconnected cushion supports 32, 34, and 36, between an upright seated configuration, once again, as shown in FIGS. 1 and 2, and an extended horizontal configuration, such as is shown best in FIG. 3. Furthermore, when the plurality of cushion support 32, 34, and 36, are moved from an upright seated configuration to an extended horizontal orientation, inner cushion support 32 pivots upwardly and forward over base frame assembly 20 about the pivot element 44 while a portion of the second terminal member 42' slides forward in positioning channel 49, to a position as generally shown in FIG. 8. Conversely, when the cushion support assembly 30 is disposed from an extended horizontal orientation to an upright seated orientation, inner cushion support 32 pivots rearward and downwardly about pivot element 44, while the second terminal member 42' moves rearward in positioning channel 49 to a position as generally shown in FIG. 7.

Figure 10:
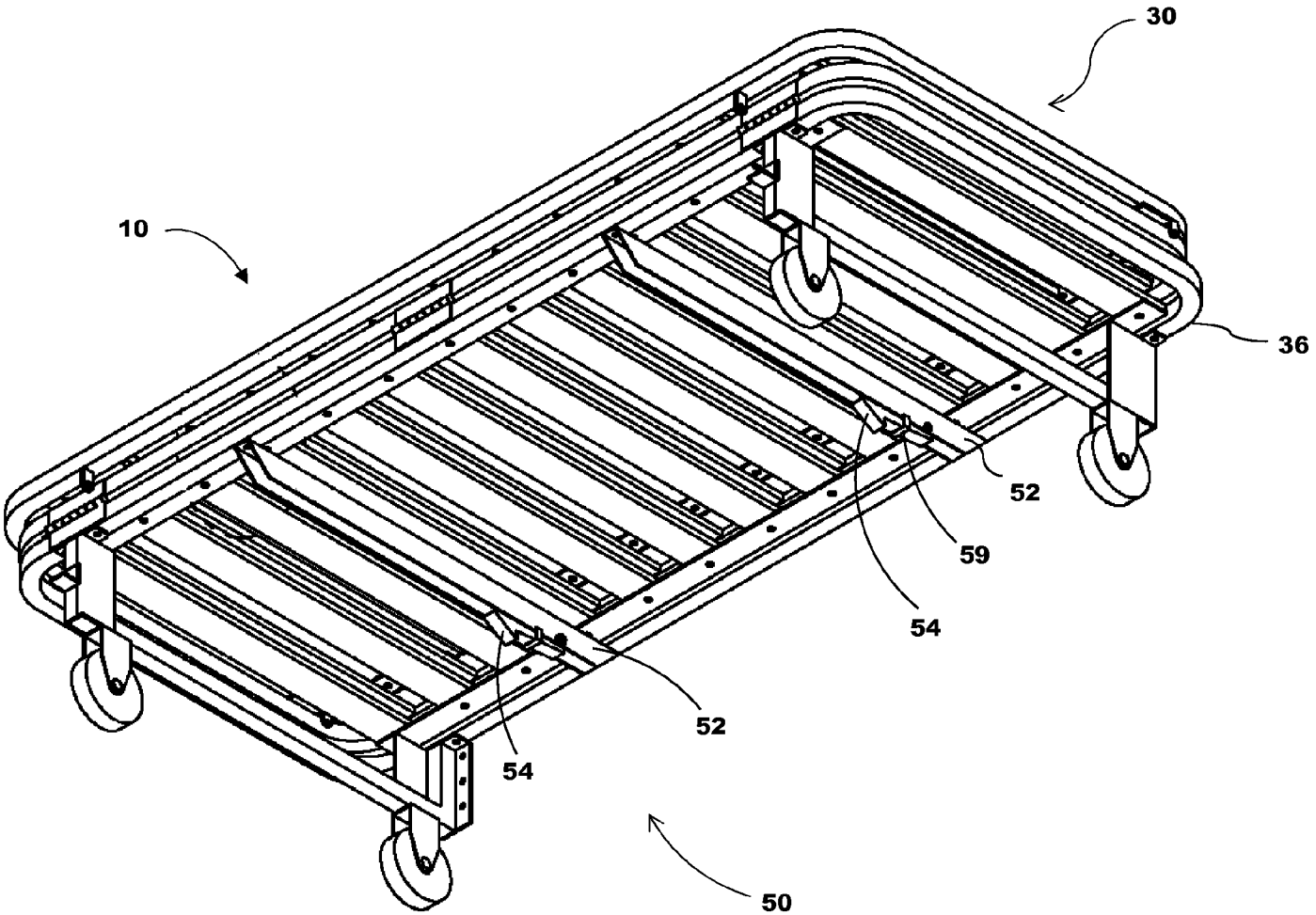
FIG. 10 is a perspective view illustrative of one embodiment of a locking assembly for a convertible furniture frame assembly in accordance with the present invention.
Figure 11:
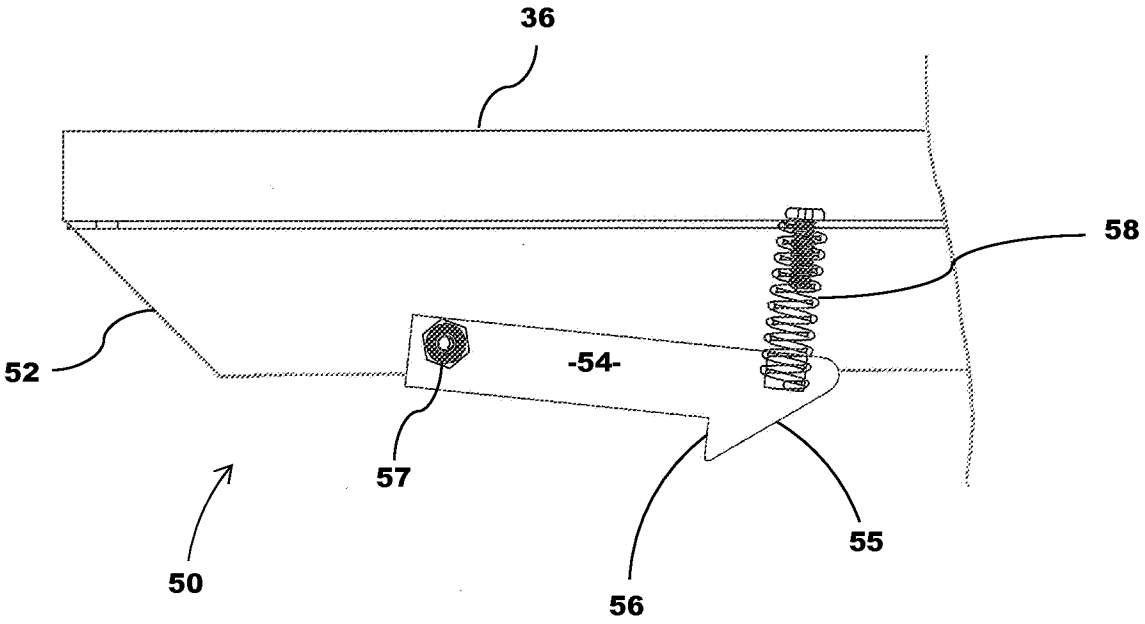
FIG. 11 is detail of a lock member of the embodiment of locking assembly of FIG. 10.

In at least one embodiment, a convertible furniture frame assembly 10 in accordance with the present invention further comprises a locking assembly 50. Locking assembly 50 includes at least one lock arm 52 disposed to operatively position at least one lock member 54 along an underside of a portion of the cushion support assembly 30, and in at least one embodiment, along an underside of the outer cushion support 36. As shown in the illustrative embodiment of FIG. 10, the locking assembly 50 comprises a plurality of lock arms 52 each attached to an underside of outer cushion support 36 and each having a corresponding lock member 54 mounted thereto. As shown in FIG. 11, each lock member 54 includes an engagement surface 55 which comprises an inclined configuration, and a lock surface 56 which is disposed substantially perpendicular to the underside of cushion support assembly 30, and more in particular, perpendicular to the outer cushion support 36.

Figure 12:
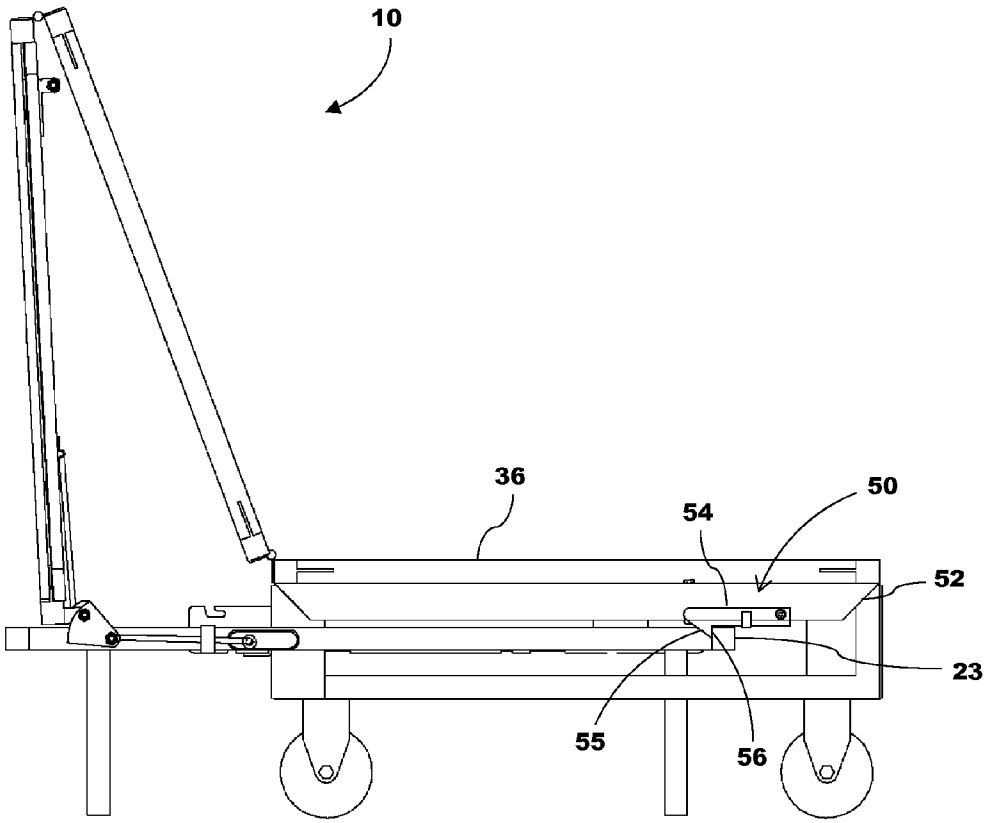
FIG. 12 is a side elevation of the embodiment of the locking assembly of FIG. 10 disposed in a locked orientation.

The lock member 54 in at least one embodiment is attached to the lock arm 52 via a pivot member 57. Further, a biasing member 58 is disposed on the underside of the lock member 54 between the lock member 54 and the corresponding lock arm 52, and the biasing member 58 serves to bias lock member 54 downwardly from the underside of cushion support assembly 30. As further illustrated in FIG. 10, a retainer 59 is provided in order to limit the downward movement of lock member 54 so as to maintain engagement surface 55 in an operative orientation for engagement with a portion of a lock rail 23 (not shown), when the cushion support assembly 30 is disposed from an extended horizontal orientation to an upright seated orientation. Specifically, when the cushion support assembly 30, and more in particular, the outer cushion support 36, is pushed rearward towards the base frame assembly 20, the engagement surface 55 of lock member 54 engages the lock rail 23 forcing the lock member 54 upwardly against the force of biasing member 58 and over top of the lock rail 23. As shown in FIG. 12, when the locking assembly 50 is disposed in the locking configuration, lock surface 56 of lock member 54 is disposed in a downwardly extending and abutting relationship to the lock rail 23. Furthermore, as will be appreciated from the foregoing, the lock member 54 is maintained in this downwardly extended position by biasing member 58, thereby preventing inadvertent movement of outer cushion support 36 towards an extended horizontal orientation.

Thus, a locking assembly 50 in accordance with the present invention releasably retains a cushion support assembly 30 in the upright seating configuration of FIGS. 1 and 2. In order to release the cushion support assembly 30 from the upright seated configuration and reposition the cushion support assembly 30 of the convertible furniture frame assembly 10 into an extended horizontal configuration, a user simply lifts slightly upwardly on the outer cushion support 36, thereby raising lock members 54 upward and over lock rail 23 and releasing the locking assembly 50, and allowing the cushion support assembly 30 to be disposed into an extended horizontal orientation, once again, as shown in FIG. 3.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A convertible furniture frame assembly for a furniture piece, said assembly comprising:

a base frame assembly having a main frame, a plurality of support members attached to said base frame assembly and disposed to maintain said convertible furniture frame assembly in an operative position, a plurality of outer rails each disposed in a spaced apart relation to said main frame, a cushion support assembly comprising a plurality of cushion supports movably interconnected to one another, wherein said cushion support assembly is disposable between an upright seated configuration and an extended horizontal configuration, a biasing assembly interconnected between said base frame assembly and said cushion support assembly to facilitate disposition of said cushion support assembly between said upright seated configuration and said extended horizontal configuration, said biasing assembly further comprises a biasing element having at least two terminal members, wherein at least one of said terminal members is fixedly secured to one of said plurality of cushion supports, and wherein at least one other of said terminal members is disposed in a sliding engagement with a portion of said base frame assembly.

2. The assembly as recited in claim 1 wherein said biasing assembly further comprises a pivot assembly, said pivot assembly disposed in a pivoting engagement between said base frame assembly and said cushion support assembly facilitating disposition of said cushion support assembly between said upright seated configuration and said extended horizontal configuration.

3. The assembly as recited in claim 2 wherein said pivot assembly comprises a pivot element pivotally interconnected to a portion of said base frame assembly.

4. The assembly as recited in claim 3 wherein said pivot assembly further comprises a fixed element fixedly mounted to said one of said plurality of cushion supports.

5. A convertible furniture frame assembly for a furniture piece, said assembly comprising:

a base frame assembly having a main frame comprising a rear rail and an oppositely disposed lock rail, said rear rail and said lock rail being interconnected by a pair of oppositely disposed mount rails, a plurality of outer rails, each of said outer rails being disposed in a spaced apart relation to a corresponding one of said plurality of oppositely disposed mount rails, a plurality of support members attached to each of said plurality of outer rails and disposed to maintain said convertible furniture frame assembly in an operative position, a cushion support assembly comprising a plurality of cushion supports, wherein said plurality of cushion supports include at least an inner cushion support, a central cushion support, and an outer cushion support, each of said plurality of cushion supports movably interconnected to one another, said cushion support assembly is disposable between an upright seated configuration and an extended horizontal configuration, a biasing assembly interconnected between said base frame assembly and said cushion support assembly facilitating disposition of said cushion support assembly between said upright seated configuration and said extended horizontal configuration, said biasing assembly comprising at least one biasing element having a first terminal member fixedly secured to a portion of said inner cushion support, said at least one biasing element further comprising a second terminal member disposed in a sliding engagement with one of said mount rails, and a locking assembly disposed to operatively engage a portion of said lock rail to releasably retain said cushion support assembly in said upright seated configuration.

6. The assembly as recited in claim 5 wherein said one of said mount rails comprises a positioning channel which slidingly receives at least a portion of said terminal member therein.

7. The assembly as recited in claim 6 wherein said biasing assembly further comprises a pivot assembly, said pivot assembly disposed in a pivoting engagement said base frame assembly between and said cushion support assembly facilitating disposition of said cushion support assembly between said upright seated configuration and said extended horizontal configuration.

8. The assembly as recited in claim 7 wherein said pivot assembly comprises at least one pivot element pivotally interconnected to one of said mount rails.

9. The assembly as recited in claim 8 wherein said pivot assembly further comprises at least one fixed element fixedly secured to said portion of said inner cushion support and operatively interconnected to said at least one pivot element and said at least one biasing element by a biasing element interconnect.

10. A convertible furniture frame assembly for a furniture piece, said assembly comprising:

a base frame assembly having a main frame comprising a rear rail and an oppositely disposed lock rail, said rear rail and said lock rail being interconnected by a pair of oppositely disposed mount rails, a plurality of outer rails, each of said outer rails being disposed in a spaced apart relation to a corresponding one of said plurality of oppositely disposed mount rails, a plurality of support members attached to each of said plurality of outer rails and disposed to maintain said convertible furniture frame assembly in an operative position, a cushion support assembly comprising a plurality of cushion supports, wherein said plurality of cushion supports include at least an inner cushion support, a central cushion support, and an outer cushion support, each of said plurality of cushion supports movably interconnected to one another, said cushion support assembly is disposable between an upright seated configuration and an extended horizontal configuration, a biasing assembly interconnected between said base frame assembly and said cushion support assembly facilitating disposition of said cushion support assembly between said upright seated configuration and said extended horizontal configuration, said biasing assembly comprises a plurality of biasing elements each having a first terminal member fixedly secured to a different portion of said inner cushion support, wherein each of said plurality of biasing elements further comprises a second terminal member disposed in a sliding engagement with a different one of said mount rails, and wherein each said different one of said mount rails comprises a positioning channel which slidingly receives at least a portion of a corresponding one of said second terminal members therein, and a locking assembly disposed to operatively engage a portion of said lock rail to releasably retain said cushion support assembly in said upright seated configuration.

* * * * *